US012414625B2

(12) United States Patent
Gillette

(10) Patent No.: US 12,414,625 B2
(45) Date of Patent: Sep. 16, 2025

(54) COLLAPSIBLE TABLE

(71) Applicant: Rivian IP Holdings, LLC, Irvine, CA (US)

(72) Inventor: Steve Gillette, Irvine, CA (US)

(73) Assignee: Rivian IP Holdings, LLC, Irvine, CA (US)

( * ) Notice: Subject to any disclaimer, the term of this patent is extended or adjusted under 35 U.S.C. 154(b) by 202 days.

(21) Appl. No.: 18/345,428

(22) Filed: Jun. 30, 2023

(65) Prior Publication Data

US 2025/0000250 A1 Jan. 2, 2025

(51) Int. Cl.
*A47B 3/00* (2006.01)
*A47B 3/08* (2006.01)

(52) U.S. Cl.
CPC ..... *A47B 3/002* (2013.01); *A47B 3/08* (2013.01); *A47B 2003/0824* (2013.01); *A47B 2200/0037* (2013.01)

(58) Field of Classification Search
CPC .. A47B 3/002; A47B 3/08; A47B 3/12; A47B 1/08; A47B 13/081; A47B 2200/095
See application file for complete search history.

(56) References Cited

U.S. PATENT DOCUMENTS 3,050 A * 4/1843 Richards ..... A47B 1/00 108/65
57,927 A * 9/1866 Lauter ..... A47B 1/08 108/83
137,779 A * 4/1873 Land ..... A47B 1/08 108/83
166,679 A * 8/1875 Bent ..... A47B 1/08 108/83
900,552 A * 10/1908 Kad ..... A47B 3/08 108/115
2,057,334 A * 10/1936 Hannum ..... A47B 3/002 5/177
2,596,663 A * 5/1952 Duffy ..... A47B 87/002 108/69
3,188,158 A * 6/1965 Sanchez ..... A47B 3/002 312/277
4,392,437 A * 7/1983 Wallace ..... A47B 3/00 108/172
5,711,229 A * 1/1998 Piretti ..... A47B 1/08 108/89
6,685,199 B2 * 2/2004 Stravitz ..... A47B 31/04 280/42
6,752,364 B1 * 6/2004 Lim ..... A47C 19/005 297/440.1
11,297,936 B2 * 4/2022 Choi ..... A47B 13/003
2015/0040802 A1 * 2/2015 Hutchison ..... A47B 1/08 108/50.11

FOREIGN PATENT DOCUMENTS

WO WO-2018004448 A1 * 1/2018 ..... A47B 1/08

* cited by examiner

*Primary Examiner* — Daniel J Rohrhoff
(74) *Attorney, Agent, or Firm* — Patterson + Sheridan, LLP

(57) ABSTRACT

The present disclosure relates to a collapsible table. In one or more embodiments, an apparatus includes a table. The table includes a first central segment and a second central segment. The table further includes a plurality of joints configured to facilitate movement of the first central segment and the second central segment. The movement of the first central segment and the second central segment causes one or more dimensions of the table to be modified.

20 Claims, 13 Drawing Sheets

COLLAPSIBLE TABLE

INTRODUCTION

The present disclosure relates to a collapsible table.

SUMMARY

The present disclosure describes a collapsible table that is particularly suitable for storage and transportation in a storage compartment of a vehicle, such as front trunk ("frunk").

In one or more embodiments, an apparatus includes a table. The table includes a first central segment and a second central segment. The table further includes a plurality of joints configured to facilitate movement of the first central segment and the second central segment. The movement of the first central segment and the second central segment causes one or more dimensions of the table to be modified.

In one or more embodiments, a method for deploying a table includes translating a first central segment and a second central segment of the table outwardly from one another to cause one or more dimensions of the table to be modified. The table includes a plurality of joints configured to facilitate the translation of the first central segment and the second central segment. The method further includes placing one or more panels on the table to form a tabletop.

DETAILED DESCRIPTION

Off-road vehicles enable a driver and passengers to explore exciting new locations. A vehicle may be provided with accessories, such as a roof-top or truck-bed tent, camp kitchens, and the like, to make overnight camping more comfortable. Although many accessories can be positioned in a truck bed or mounted to a roof rack, users will also need to store gear and supplies within the vehicle itself. Accordingly, it is advantageous to make gear for storage within the vehicle itself as compact as possible.

The present disclosure describes a collapsible table that is well suited to be stored within a storage compartment of a vehicle, such as a rear trunk, front trunk ("frunk"), or other cargo area of a vehicle. The collapsible table may be specifically sized to be stored laid flat or oriented vertically within the storage compartment of a particular vehicle. The collapsible table includes a tabletop frame having a collapsed and deployed configuration and work surface composed of a plurality of panels that conform to the size of the tabletop frame when in the collapsed configuration. The tabletop frame and the plurality of panels may therefore be stacked on top of one another and placed in a space that is much smaller than a footprint of the collapsible table when in the deployed configuration.

Figure 1A:
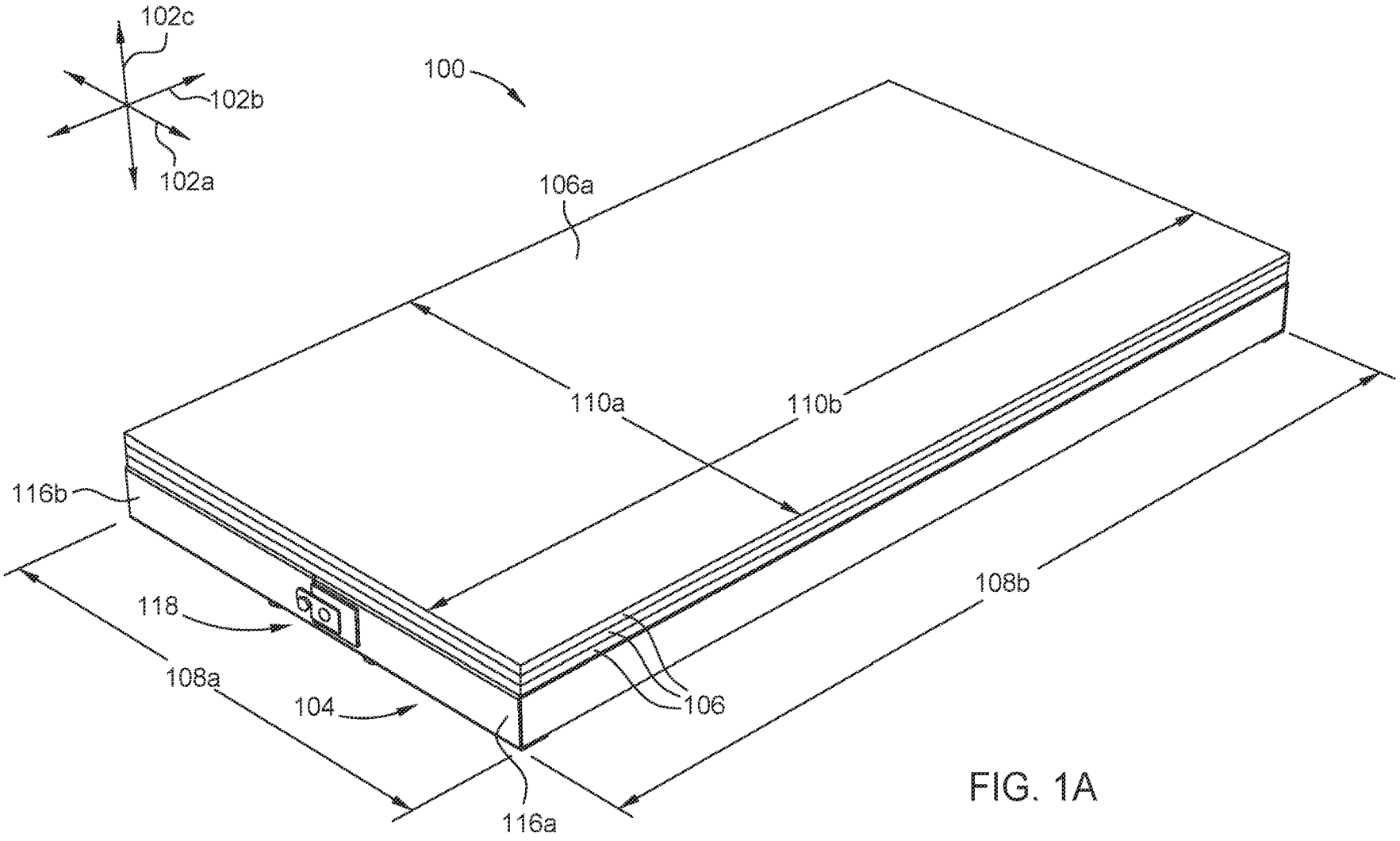
FIG. 1A illustrates a collapsible table in a collapsed configuration, in accordance with certain embodiments.
Figure 1B:
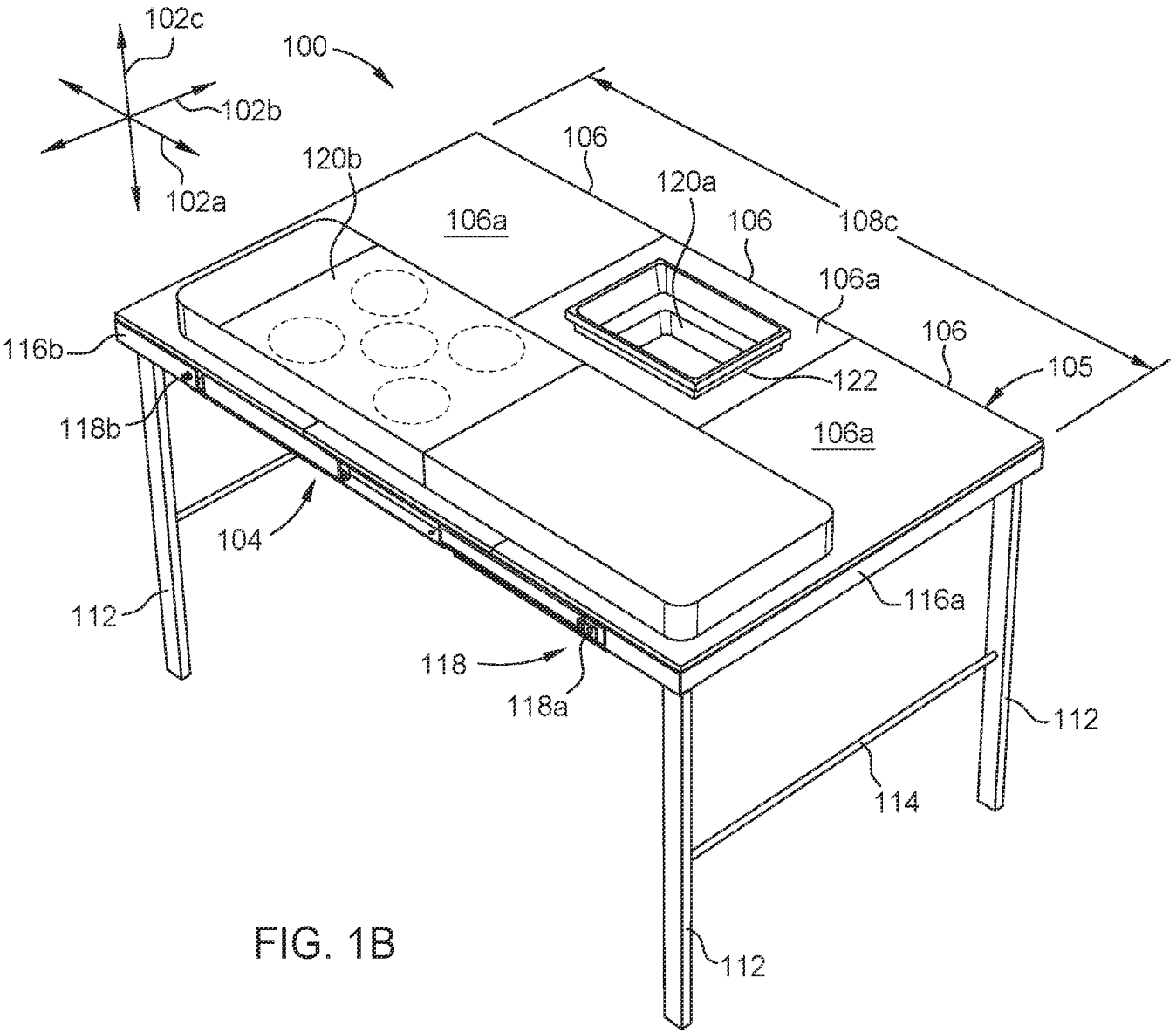
FIGS. 1B and 1C illustrate the collapsible table in a deployed configuration with various mounted accessories, in accordance with certain embodiments.
Figure 1C:
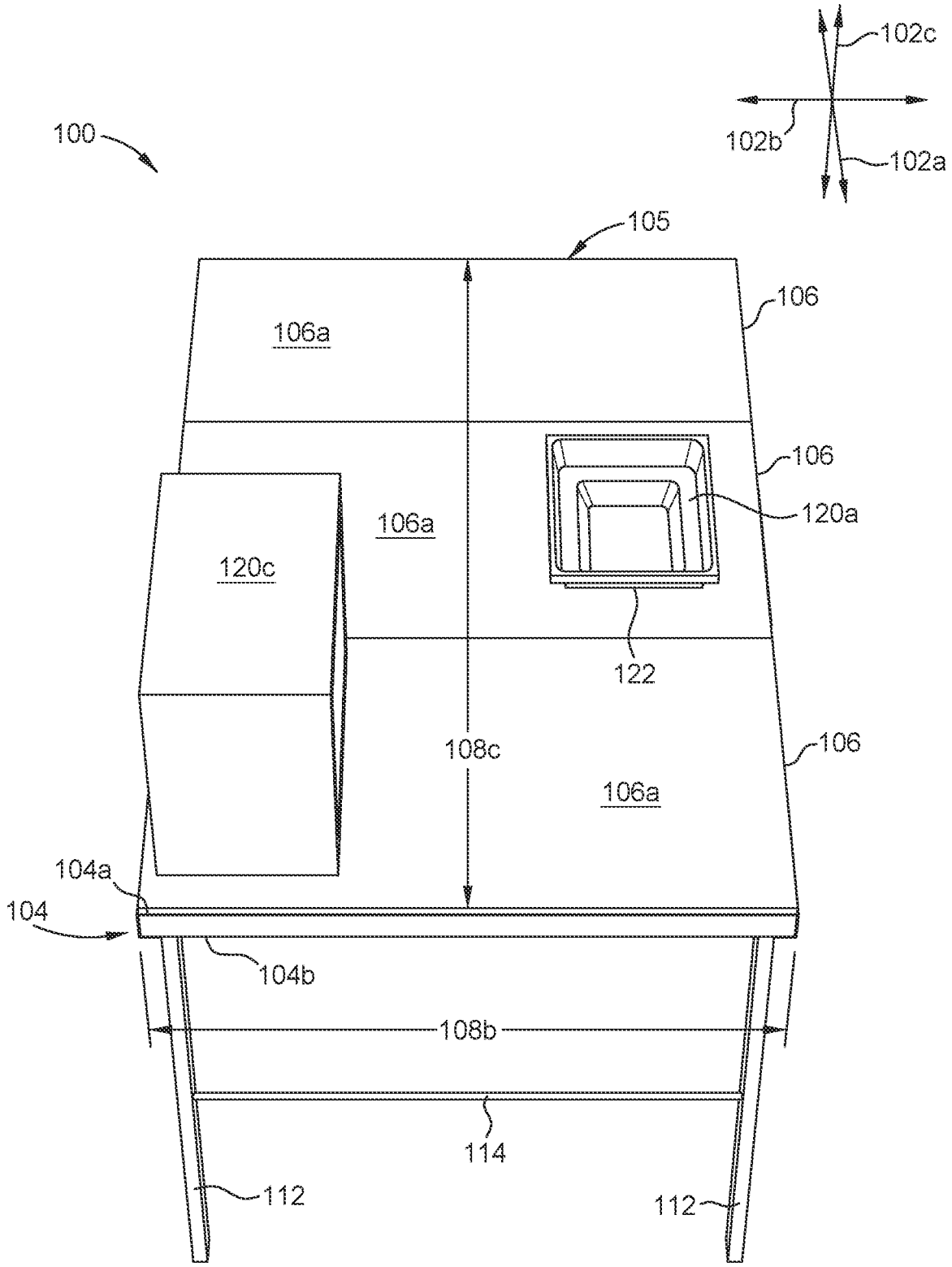

Referring to FIGS. 1A to 1C, a collapsible table 100 may be understood with respect to a horizontal direction 102*a*, a longitudinal direction 102*b*, and a vertical direction 102*c* that are all perpendicular to one another. The collapsible table 100 is described with respect to the directions 102*a*, 102*b*, 102*c* (which may also be referred to in reference to a length, a width, and a height of the collapsible table 100, respectively) to facilitate understanding of the relative positions and orientations of components of the table 100 with the understanding that the directions 102*a*, 102*b*, 102*c* need not correspond to the actual orientation of the collapsible table 100 during use. In the following description, the directions 102*a*, 102*b*, 102*c* are defined relative to a tabletop frame 104 of the table 100.

The table 100 has a collapsed configuration shown in FIG. 1A in which the tabletop frame 104 is collapsed and two, three, or more panels 106 may be stacked with the tabletop frame 104 (above or below the tabletop frame 104) to achieve a compact size. The tabletop frame 104 has a dimension 108*a* in the horizontal direction 102*a* and a dimension 108*b* in the longitudinal direction 102*b* when in the collapsed configuration. In the illustrated embodiment, dimension 108*b* is greater than the dimension 108*a*, such as between 1.5 and 3 times greater.

The panels 106 are generally planar members with a planar surface 106*a* that, when stacked with the tabletop frame 104, are substantially (e.g., within 5 degrees of) orthogonal to the vertical direction 102*c* defined by the tabletop frame 104. In the illustrated embodiment, the panels 106 each have a rectangular shape in a plane parallel to the planar surface 106*a* thereof. The panels 106 may have edges conforming to a rectangular shape with other features extending between edges, such as one or more beveled corners (see, e.g., FIG. 3B) or rounded corners. In various embodiments, other shapes may be implemented such that each panel 106 has at least one edge lying on the rectangular shape, each panel 106 is substantially contained within the rectangular shape, and each panel 106 can abut with another panel of the plurality of panels 106.

The rectangular shape has a dimension 110*a* and a dimension 110*b* perpendicular to the dimension 110*a* in a plane parallel to the planar surface 106*a*. The dimension 110*a* and the dimension 110*b* may be substantially (e.g., within 5, 10, or 15 percent of) equal to the dimensions 108*a*, 108*b*, respectively. In some embodiments, the dimensions 110*a*, 110*b* are no greater than the dimensions 108*a*, 108*b*, respectively. In this manner, the panels 106 and tabletop frame 104 may be stacked in the compact configuration shown in FIG. 1A.

Although the panels 106 are shown as having a rectangular shape, other shapes are may be implemented. For example, the panels 106 may include a rectangular panel and two semi-circular panels that together define a discorectangle in a deployed configuration. In the illustrated embodiment, the panels 106 are substantially (e.g., within 5 percent of) equal to one another. However, other configurations may be implemented. For example, two panels with rounded or beveled edges may be used on either side of a third panel that is both smaller and rectangular.

The panels 106 may be made of a material that is sufficiently strong to avoid deflection during use and withstand abrasion. The panels 106 may be made of wood, metal (e.g., aluminum or steel) or plastic (e.g., polyvinyl chloride (PVC), acrylonitrile butadiene styrene (ABS), polypropylene, acrylic, polyethylene, polystyrene, or the like). The panels 106 may be made of a composite material, such as a carbon fiber, fiberglass, Kevlar, or other composite material.

The tabletop frame 104 may be made of steel, aluminum, or any other material, such as the plastic or composite materials listed above. Unless otherwise noted below, the members of the tabletop frame 104 may be made of round or rectangular tubes, such as tubes with cross-sectional dimensions of between 2 and 10 cm and a wall thickness between 2 and 4 mm for metal with plastic or composite materials possibly having greater wall thickness.

Referring to FIG. 1B, while still referring to FIG. 1A, in the deployed configuration, the tabletop frame 104 has a dimension 108*c* in the horizontal direction 102*a* that is much larger than the dimension 108*a*, such as at least two times, at least three times, or some a greater multiple. For example, as shown in FIG. 1B, the dimension 108*c* is substantially (e.g., within 10 percent of) equal to an integer multiple of the dimension 108*a*, where the integer multiple is equal to the number of the panels 106, e.g., two, three, or larger value.

In the deployed configuration, the panels 106 are rested on the tabletop frame 104 with the dimension 110*b* thereof oriented substantially (e.g., within 5 degrees of) parallel to the longitudinal direction 102*b* and the dimension 108*b* of the tabletop frame 104, with edges of adjacent panels 106 defining a gap of less than 5 mm, 2 mm, or 1 mm, or abutting one another. When resting on the tabletop frame 104, the planar surfaces 106*a* of the panels 106 may be substantially (e.g., within 2 degrees of) parallel to one another and substantially coplanar (e.g., having centers thereof within 5, 2, or 1 mm of one another along the vertical direction 102*c*). The panels 106 may extend outwardly from the tabletop frame 104 in one or both of the horizontal and longitudinal directions 102*a*, 102*b* or may be positioned at or completely within the perimeter of the tabletop frame 104 along one or both of the horizontal and longitudinal directions 102*a*, 102*b*.

In the deployed configuration, legs 112 may be secured to the tabletop frame 104 with the legs 112 extending downwardly from a lower surface 104*b* of the tabletop frame 104 with the panels 106 resting on an upper surface 104*a* of the tabletop frame 104 opposite the lower surface 104*b* along the vertical direction 102*c* to form a tabletop 105. In the deployed configuration, the tabletop 105 may include a surface defined by multiple panels 106 (e.g., two panels 106, three panels 106, or more panels 106), as shown in FIGS. 1B and 1C. In a partially deployed or collapsed configuration, the tabletop 105 may include a surface defined by a single panel 106 (e.g., with one or more panels 106 stacked underneath the single panel 106, as shown in FIG. 1A). The legs 112 may extend downwardly from the lower surface 104*b* with a longest dimension thereof substantially (e.g., within 5 degrees of) parallel to the vertical direction 102*c*. In the collapsed configuration, the legs 112 may be either (a) detached from the tabletop frame 104 or (b) pivoted such that the longest dimensions thereof is substantially perpendicular to the vertical direction 102*c*, such as at an angle of between 80 and 90 degrees or between 85 and 90 degrees relative to the vertical direction 102*c*. An example embodiment including legs 112 pivotally secured to the tabletop frame 104 is described in further detail below. In still other embodiments, the legs 112 are at some other non-perpendicular angle when in the deployed configuration, e.g., scissor legs.

In some embodiments, one or more braces 114 may be mounted to pairs of legs 112 to resist folding of the legs 112 relative to the tabletop frame 104. For example, in the illustrated embodiment, a brace 114 connects pairs of legs 112 that are offset from one another along the longitudinal direction 102*b* and substantially aligned (e.g., within 2 cm) along the horizontal direction 102*a*. Stated differently, legs 112 positioned adjacent corners that are connected by a common edge of the tabletop frame 104 may be connected by a brace 114. The longest dimension of each brace 114 may be oriented substantially (e.g., within 5 degrees of) parallel to one of the directions 102*a*, 102*b* or may be positioned diagonally between legs 112 offset from one another along both of the horizontal and longitudinal directions 102*a*, 102*b*. The brace 114 may secure to legs 112 by threading into threaded holes formed on the legs 112 or engaging a mounting bracket or some other mounting structure secured to the legs 112.

In the illustrated embodiment, the tabletop frame 104 includes a first end segment 116*a* and a second end segment 116*b*. The first and second end segments 116*a*, 116*b* may have fixed dimensions in the longitudinal direction 102*b* that does not change between the collapsed and deployed configurations. The distance between the first and second end segments 116*a*, 116*b* is expanded when transitioning from the collapsed configuration to the deployed configuration.

One or more fasteners 118 may be used to secure the first and second end segments 116*a*, 116*b* to one another in the collapsed configuration. The one or more fasteners 118 may be disengaged to transition the tabletop frame 104 to the deployed configuration. For example, the illustrated fastener 118 may be used alone or with a second fastener (not shown) on an opposite side of the tabletop frame 104 along the longitudinal direction 102*b*.

In the illustrated embodiment, the fastener 118 may include a pivoting hook 118*a* secured to the first end segment 116*a* that engages a post 118*b* secured to the second end segment 116*b* (or vice versa). The fastener 118 may also be embodied as an over-center latch secured to the first end segment 116*a* engaging a hook secured to the second end segment 116*b* (or vice versa) or a strap secured to the first end segment 116*a* and engaging a buckle on the second end segment 116*b* (or vice versa). The fastener 118 may be embodied as a clip portion secured to the first end segment 116*a* and engaging a clip portion secured to the second end segment 116*b*, such as a portion of a side-release buckle or other type of clip. The fastener 118 may also be implemented as other types of fasteners.

As shown in FIGS. 1B and 1C, various accessories 120*a*, 120*b*, 120*c* may be used with the table 100 when in the deployed configuration. For example, a panel 106 may define an opening 122 that receives a basin 120*a*, such as the illustrated collapsible basin. The basin 120*a* may either be removed from the opening 122 when the table 100 is in the collapsed configuration or the basin 120*a* may remain in the opening 122 in a collapsed state when the table 100 is in the collapsed configuration. Accessories used with the table 100 may include a stove 120*b* supported on the table 100. The stove 120*b* may have a length equal to or greater than the dimension 108*c* of the table 100 in the deployed configuration. The stove 120*b* may be a gas or electric stove, such as an electric stove powered by the battery of an electric vehicle. In some embodiments, a storage structure 120*c* (FIG. 1C) rests on or mounts to one or more of the panels 106. The storage structure 120*c* may define one or more shelves, drawers, bins, or other storage compartments for storing kitchen utensils, tools, or other items. One or more panels may define one or more registration features (e.g., registration holes, pins, mounting brackets, etc.) for mounting the illustrated accessories 120*b*, 120*c* or other accessories.

Figure 1D:
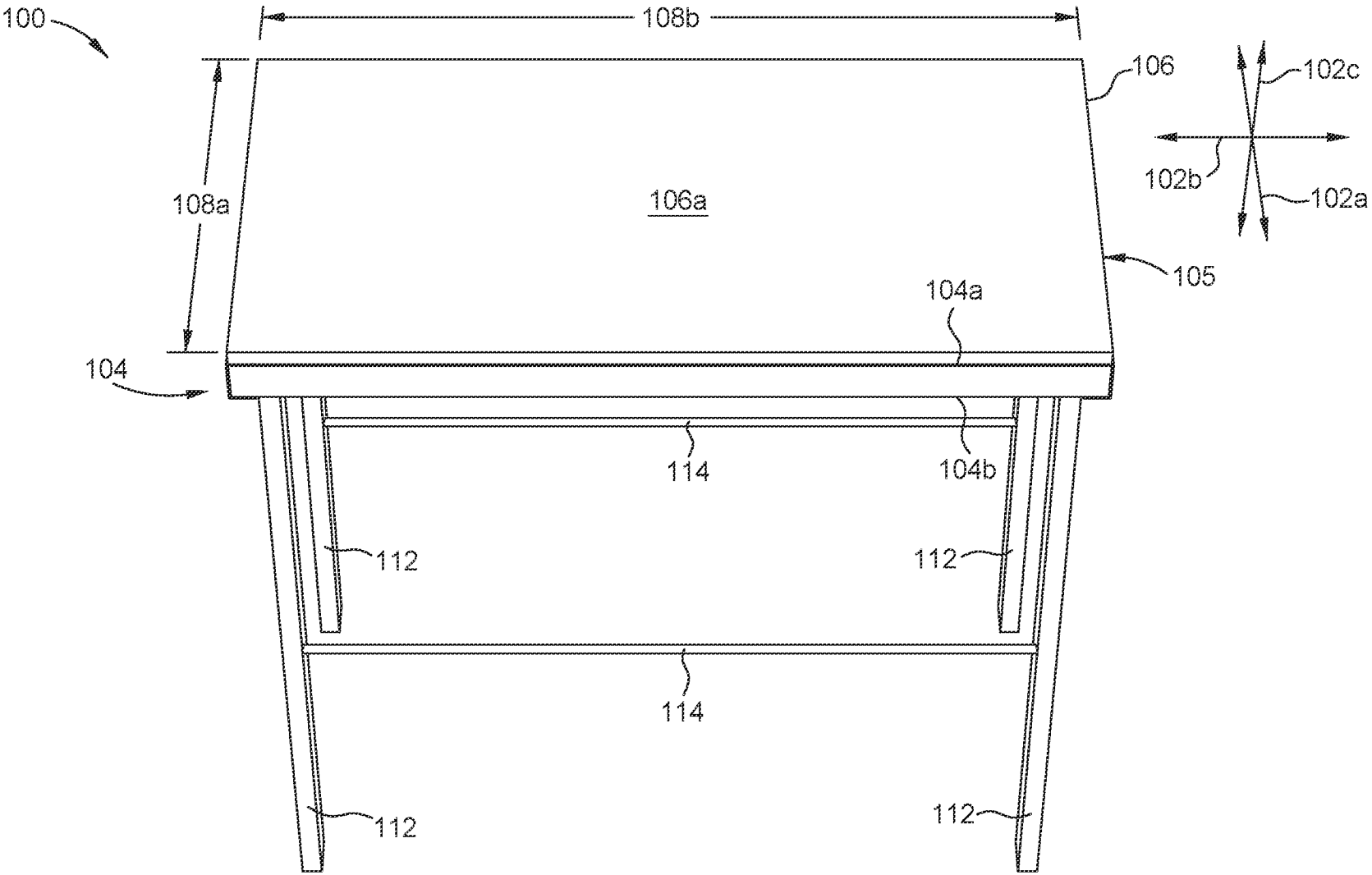
FIG. 1D illustrates the collapsible table in a partially deployed configuration, in accordance with certain embodiments.

Referring to FIG. 1D, in some embodiments, the table 100 may be used in a partially deployed configuration in which the tabletop frame 104 remains in the collapsed configuration, i.e., having dimensions 108*a*, 108*b*, with the legs 112 in their deployed configuration. A single panel 106 may then be rested on the tabletop frame 104, or multiple panels 106 stacked on top of one another.

FIGS. 2A to 2F illustrate the process of transitioning the table 100 from the collapsed configuration to the deployed configuration as well as an example embodiment of structures of the tabletop frame 104 facilitating the transition. The process of transitioning the table 100 from the deployed configuration to the collapsed configuration is the reverse of the process of transitioning the table 100 from the collapsed configuration to the deployed configuration.

Figure 2A:
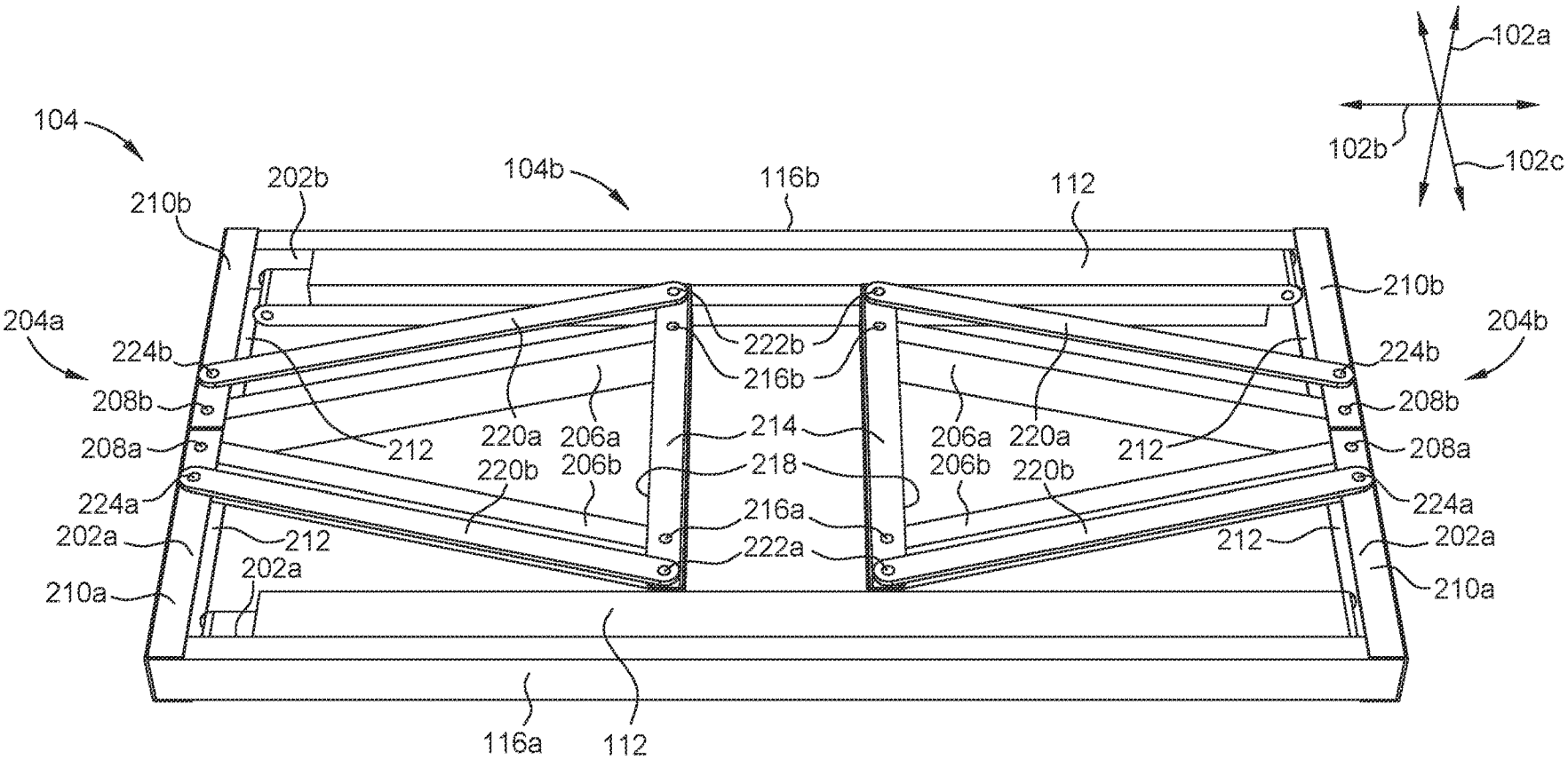
FIG. 2A illustrates a tabletop frame of the collapsible table in the collapsed configuration, in accordance with certain embodiments.

Referring specifically to FIG. 2A, the first and second end segments 116*a*, 116*b* define inwardly facing surfaces 202*a*. 202*b*. The inwardly facing surfaces 202*a*, 202*b* face inwardly into the tabletop frame 104 and define a space in which a plurality of links are positioned in the collapsed configuration. The inwardly facing surfaces 202*a*, 202*b* may be substantially (e.g., within 5 degrees of) parallel to the vertical direction 102*c* or may be rounded or have some other orientation.

The first end segment 116*a* and the second end segment 116*b* are joined to one another by collapsible sides 204*a*, 204*b*, respectively, that are positioned between the inwardly facing surfaces 202*a*, 202*b* along the horizontal direction when the tabletop frame 104 is in the collapsed configuration. The collapsible sides 204*a*, 204*b* may have a mirrored configuration with respect to one another. Each collapsible side 204*a*, 204*b* includes a plurality of joints facilitating movement of the first end segment 116*a* relative to the second end segment 116*b* to modify the dimensions of the tabletop frame 104, such as from having the dimension 108*a* to having the dimension 108*c*. For example, each collapsible side 204*a*, 204*b* may include a pivotable portion 206*a* that is pivotally connected by pivot 208*a* to the first end segment 116*a* and a pivotable portion 206*b* that is pivotally connected by pivot 208*b* to the second end segment 116*b*.

In the illustrated embodiment, the first and segments 116*a*, 116*b* may each include extensions 210*a*, 210*b*, respectively, that are rigidly secured to either end of the first and second end segments 116*a*. 116*b* along the longitudinal direction 102*b*. The extensions 210*a*, 210*b* may secure to the first and second end segments 116*a*, 116*b* by either being monolithically formed as part of the first and second end segments 116*a*, 116*b* or being fastened to the first and second end segments 116*a*. 116*b* by bolts, welds, or other type of fastener. The extensions 210*a*, 210*b* extend outwardly relative to the inwardly facing surfaces 202*a*, 202*b* and inwardly into the tabletop frame 104 along the horizontal direction 102*a*. The pivots 208*a*, 208*b* may pivotally mount the pivotable portions 206*a*, 206*b* to the extensions 210*a*, 210*b*, respectively, such that the pivots 208*a*, 208*b* are offset inwardly from the inwardly facing surfaces 202*a*. 202*b*, such as by between 10 and 50 percent of the dimension 108*a*.

In the illustrated embodiment, outward facing (e.g., facing outwardly in the horizontal direction 102*a*) surfaces of the first end segment 116*a* and the second end segment 116*b* are parallel to the longitudinal direction 102*b* and outward facing (e.g., facing outwardly in the longitudinal direction 102*b*) surfaces of the extensions 210*a*, 210*b* are parallel to the horizontal direction 102*a*. However, other configurations may also be used, including extensions 210*a*, and/or extensions 210*b* with outward facing surfaces that define a diagonal with respect to the outward facing surfaces of the first end segment 116*a* and the second end segment 116*b*, such as for use in the embodiment shown in FIG. 3B.

In the illustrated embodiments, the extensions 210*a*, 210*b* define inwardly facing cavities 212 into which the pivotable portions 206*a*. 206*b*, respectively, are inserted. For example, the extensions 210*a*, 210*b* may be implemented using portions of U-channel bars with the opening of the U-channel facing inwardly into the tabletop frame 104. The pivots 208*a*, 208*b* may be implemented as pins, bolts, or other fasteners passing into the cavities 212 and through the pivotable portions 206*a*, 206*b*, respectively.

The plurality of joints of each collapsible side 204*a*, 204*b* may further include a central segment 214. The pivotable portions 206*a*, 206*b* of each collapsible side 204*a*, 204*b* extend from the pivots 208*a*, 208*b*, respectively to the central segment 214 and are pivotably secured to the central segment 214 by pivots 216*a*, 216*b*, respectively. In the illustrated embodiment, the central segment 214 defines a cavity 218 that receives the pivotable portions 206*a*, 206*b*. For example, the central segment 214 may be implemented as a U-channel bar with the opening of the U-channel facing outwardly from the tabletop frame 104, i.e., the opposite direction from the cavities 212 of the extensions 210*a*, 210*b*. The pivots 216*a*, 216*b* may be implemented as pins, bolts, or other fasteners passing into the cavity 218 and through the pivotable portions 206*a*, 206*b*, respectively.

The offset along the horizontal direction 102*a* between the pivots 208*a*, 208*b* and the first and second end segments 116*a*, 116*b*, the offset along the horizontal direction 102*b* between the pivots 216*a*, 216*b* securing the pivotable portions 206*a*, 206*b* to the central segment 214, and the distance between the pivots 208*a*, 208*b* and the pivots 216*a*. 216*b* along each pivotable portion 206*a*, 206*b* defines the dimension 108*c* of the table 100 when in the deployed configuration. The extent of the extensions 210*a*, 210*b* outwardly from the first and second end segments 116*a*, 116*b* in the horizontal direction 102*a* may define the dimension 108*a* of the tabletop frame 104 in the collapsed configuration.

The offset between the inwardly facing surfaces 202*a*, 202*b* along the horizontal direction 102*a* in the collapsed configuration may define the limit to the length of the central segments 214. For example, the central segments 214 may have lengths of between 50 and 98 percent of the dimension

108*a* in some embodiments, though other configurations may be implemented. The dimension 108*b* may define the limit to the length of the pivotable portions 206*a*, 206*b*, i.e., the length at which the central segments 214 of the collapsible sides 204*a*, 204*b* will interfere with one another, though overlap is permitted in other embodiments. The offset between the pivots 216*a*, 216*b* on the central segments 214 facilitates increasing the dimension 108*c* without the need to increase the dimension 108*b* to accommodate longer pivotable portions 206*a*, 206*b*. Stated more generally, the length of the extensions 210*a*, 210*b* and length of the central segments 214 between the pivots 216*a*, 216*b* are variables that can be adjusted to achieve desired dimensions 108*a* and 108*c* for the tabletop frame 104 for a given dimension 108*b*.

Control arms 220*a*, 220*b* may pivotally mount to the central segment 214 and to the extensions 210*a*, 210*b*, respectively, of each collapsible side 204*a*, 204*b*. The control arms 220*a*, 220*b* constrain the central segment 214 to move substantially (e.g., within 10 degrees of) parallel to the horizontal direction 102*a*. This constraint enables a user to transition the tabletop frame 104 more easily between the deployed and collapsed configuration by eliminating some degrees of freedom and therefore eliminating potentially uncontrolled or unpredictable pivoting of members of the tabletop frame 104.

In the illustrated embodiment, each control arm 220*a*, 220*b* secures to a portion of the central segment 214 extending outwardly from the pivots 216*a*, 216*b* by means of pivots 222*a*, 222*b*, respectively. The control arms 220*a*, 220*b* are also pivotably secured to the extensions 210*a*. 210*b* by means of pivots 224*a*. 224*b*, respectively. In the illustrated embodiment, the control arms 220*a*, 220*b* are implemented as flat plates that are thinner in the vertical direction 102*c* than in the horizontal and longitudinal directions 102*a*, 102*b*. The control arms 220*a*, 220*b* may be straight as in the illustrated embodiment or may be curved in a plane parallel to the horizontal and longitudinal directions 102*a*, 102*b* to provide clearance for the pivots 208*a*, 208*b* when the collapsible sides 204*a*, 204*b* are in the deployed configuration. In the illustrated embodiment, the control arms 220*a*, 220*b* are mounted on lower surfaces of the central segment 214 and extensions 210*a*, 210*b* facing away from panels 106 resting on the tabletop frame 104, though other arrangements are also possible.

Figure 2B:
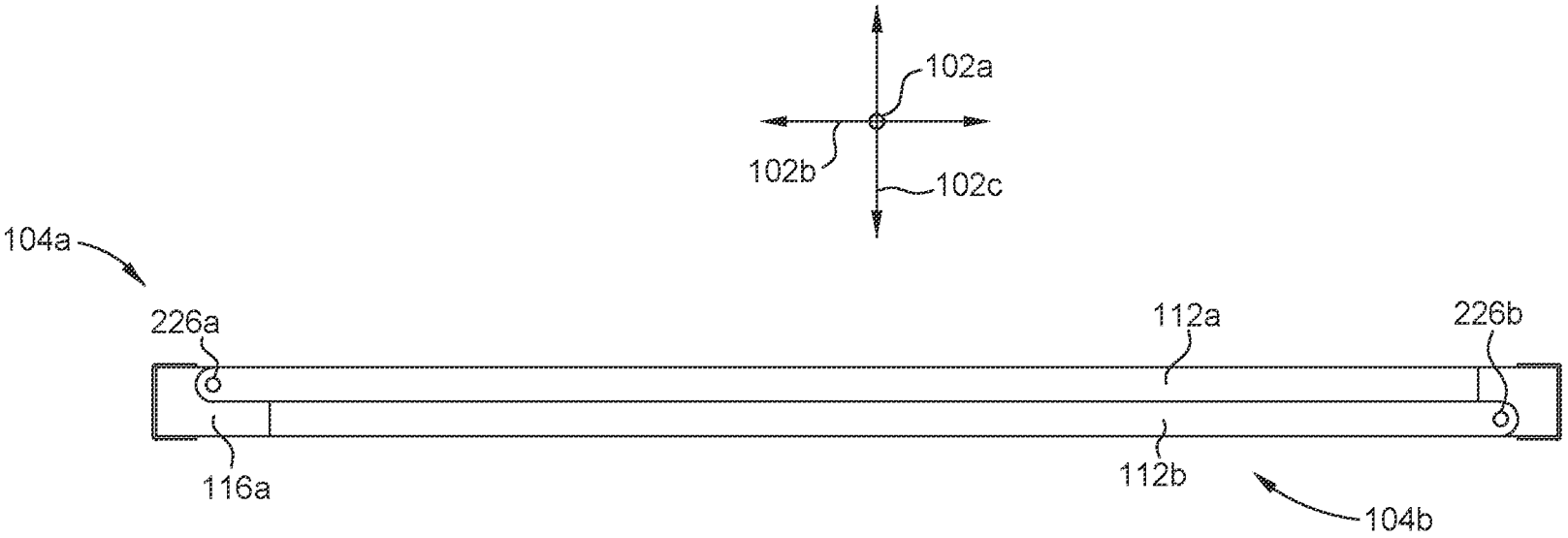
FIG. 2B illustrates the arrangement of the legs of the collapsible table in the collapsed configuration, in accordance with certain embodiments.

Referring to FIG. 2B, while still referring to FIG. 2A, a pair of legs 112 may be pivotably mounted to each of the first and second end segments 116*a*, 116*b*. FIG. 2B is shown and described with respect to the first end segment 116*a* with the second end segment 116*b* being configured in the same manner. A leg 112*a* of a pair of legs 112 is mounted by pivot 226*a* to the first end segment 116*a* and the leg 112*b* of the pair of legs 112 is mounted to the first end segment 116*a* by pivot 226*b*. The axis of rotation of the pivots 226*a*, 226*b* may be substantially (e.g., within 5 degrees of) parallel to the longitudinal direction 102*b*. The pivots 226*a*, 226*b* are offset from one another along the longitudinal direction 102*b* by an amount less than the dimension 108*b*, such as between 75 and 95 percent of the dimension 108*b*. The pivots 226*a*, 226*b* may also be offset from one another in the vertical direction 102*c*, such as by an amount approximately (e.g., within 5 percent of) equal to the thickness of the legs 112*a*, 112*b* in the vertical direction when oriented with the long dimensions thereof substantially (e.g., within 5 degrees of) parallel to the longitudinal direction 102*b*. In this manner, the legs 112*a*, 112*b* may be placed substantially parallel to the longitudinal direction 102*b*. The leg 112*b* mounted to the pivot 226*b* that is lower when the table 100 is oriented with the legs 112 in the deployed configuration and resting on a support surface may be shorter than the other leg 112*a* of the pair of legs 112 to compensate for the different positions of the pivots 226*a*, 226*b* along the vertical direction 102*c*.

Figure 2C:
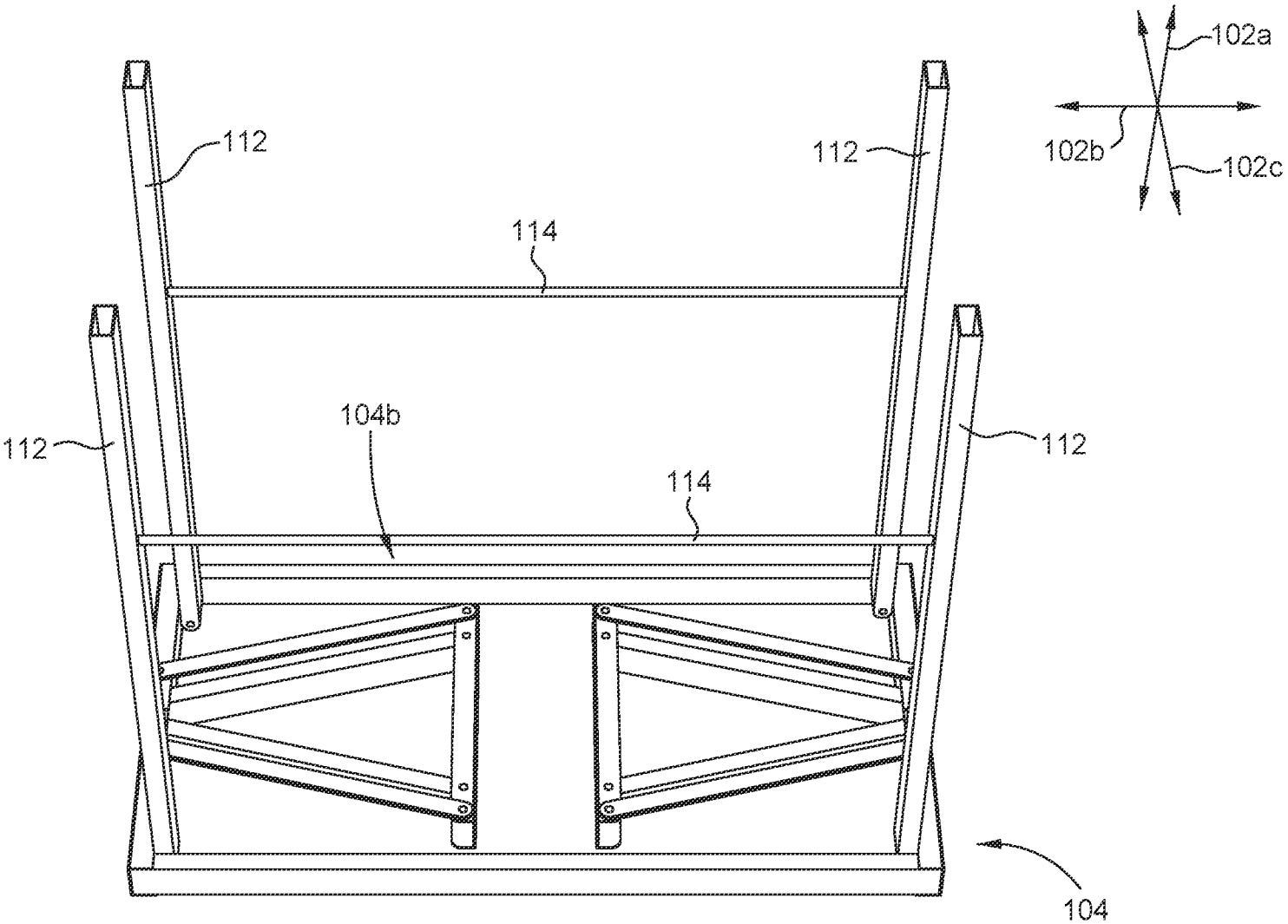
FIGS. 2C and 2D illustrate the collapsible table with the legs thereof deployed and a tabletop frame thereof collapsed, in accordance with certain embodiments.
Figure 2D:
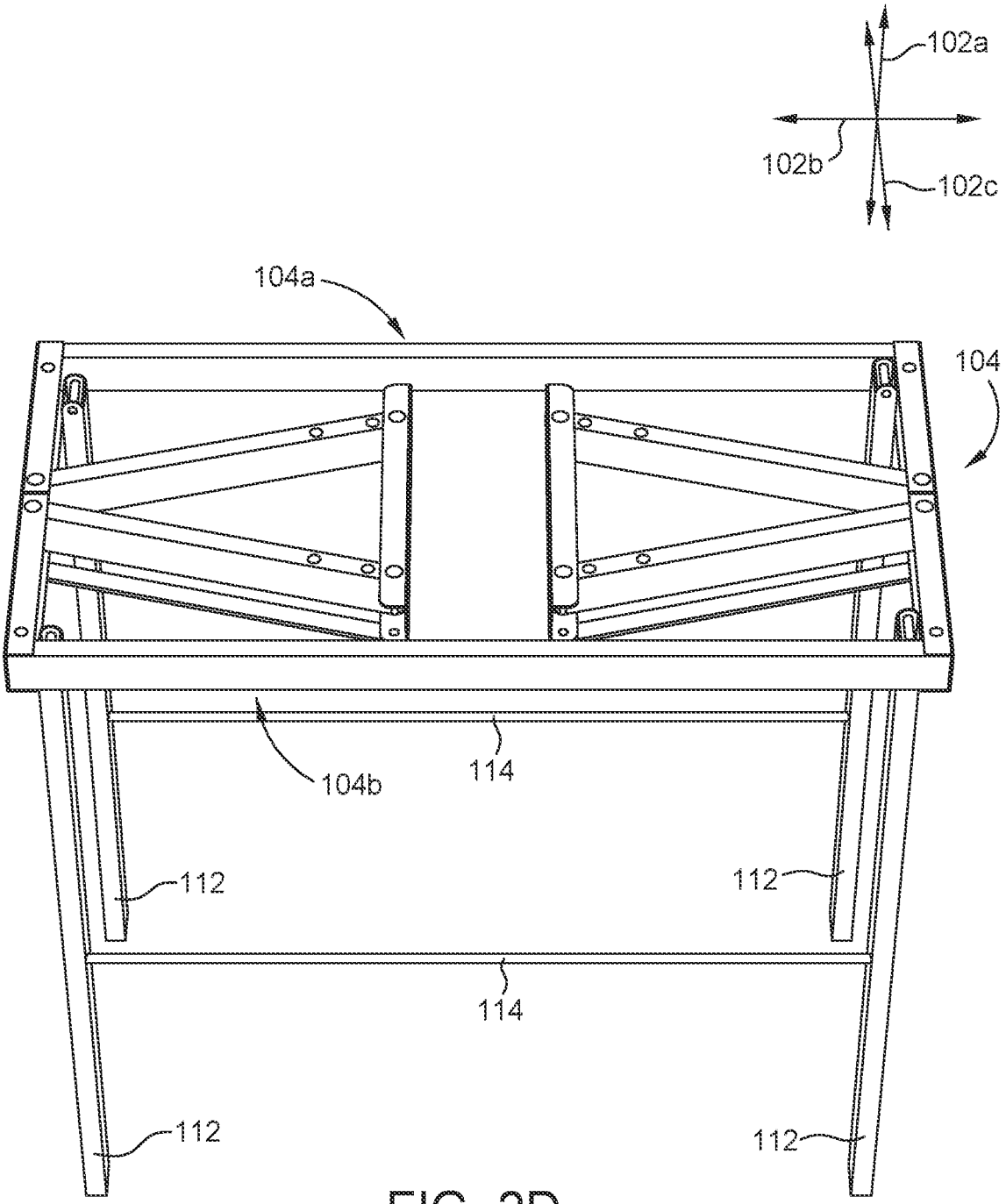

Referring to FIG. 2C, when transitioning from the collapsed configuration to the deployed configuration, the legs 112 may be first transitioned to the deployed configuration as shown with the tabletop frame 104 upside down and resting on a support surface. The braces 114 may be put in place to prevent the legs 112 from pivoting back toward the tabletop frame 104. Alternatively, a detent or other fastener may be used to prevent the legs 112 from pivoting away from the deployed configuration. Referring to FIG. 2D, a user may then flip the table 100 such that the legs 112 are positioned between the tabletop frame 104 and the support surface. As shown, in both the partially deployed and collapsed configurations, the central segments 214 are positioned within an outer perimeter of the tabletop frame 104.

Figure 2E:
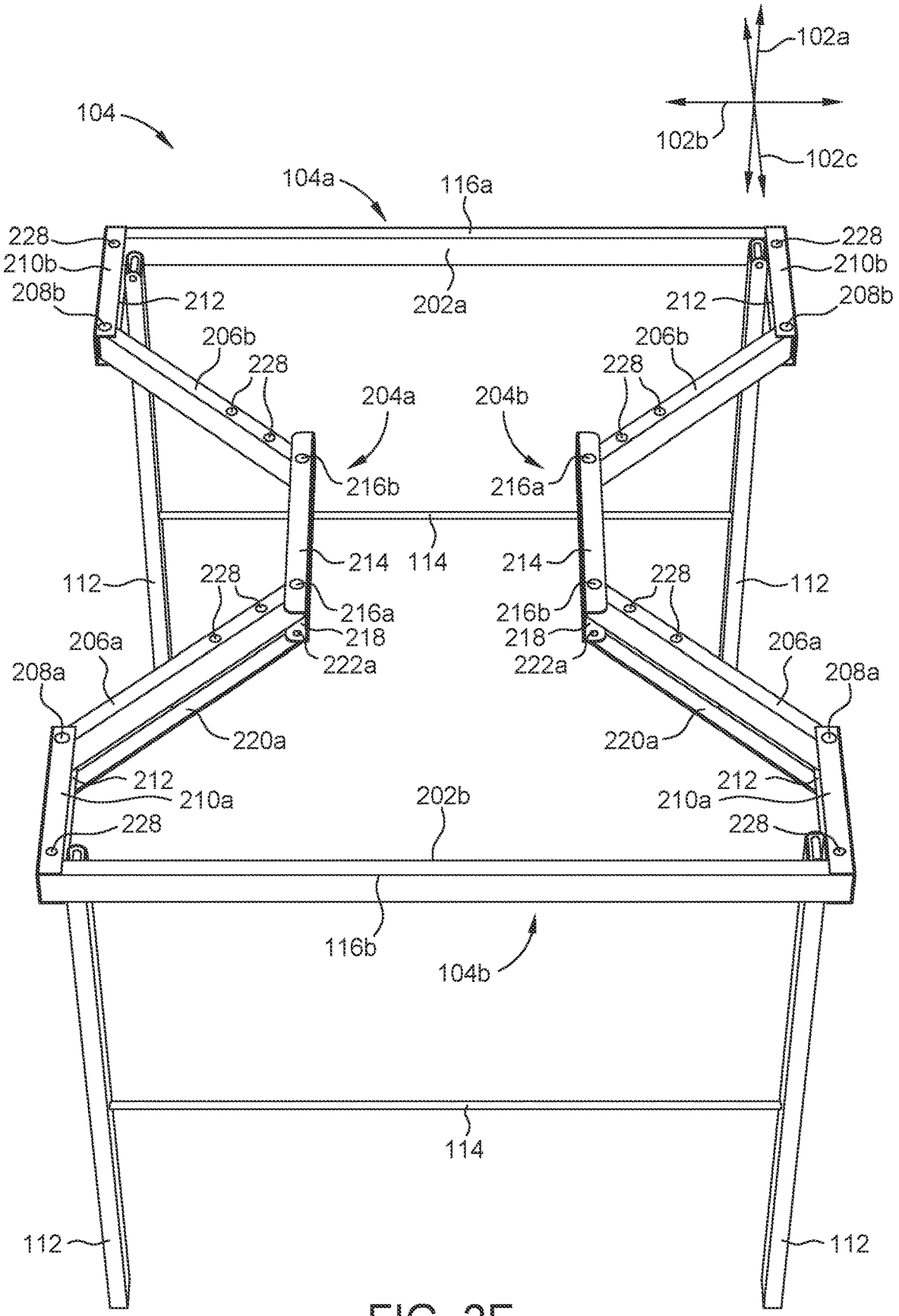
FIG. 2E illustrates the tabletop frame of the collapsible table in an intermediate configuration between the collapsed configuration and the deployed configuration.

Referring to FIG. 2E, the user may then urge the central segments 214 of the collapsible sides 204*a*, 204*b* outwardly from one another, which results in the first and second end segments 116*a*, 116*b* also being forced outwardly from one another. Alternatively or additionally, the user may pull the first and second end segments 116*a*, 116*b* apart from one another, thereby causing the central segments 214 of the collapsible sides 204*a*, 204*b* to move outwardly from one another. The constrained movement imposed by the control arms 220*a*, 220*b* may facilitate the above-described movement of the central segments 214 and the first and second end segments 116*a*, 116*b*. Accordingly, in various embodiments, the control arms 220*a*, 220*b* ensure that deployment of the tabletop frame 104 proceeds in a controlled manner (e.g., with the central segments 214 remaining substantially parallel to one another and the end segments 116*a*, 116*b* remaining substantially parallel to one another), improving case of use and enabling the tabletop frame 104 to be more reliably used in an intermediate configuration, as discussed below in further detail in conjunction with FIG. 2E.

Figure 2F:
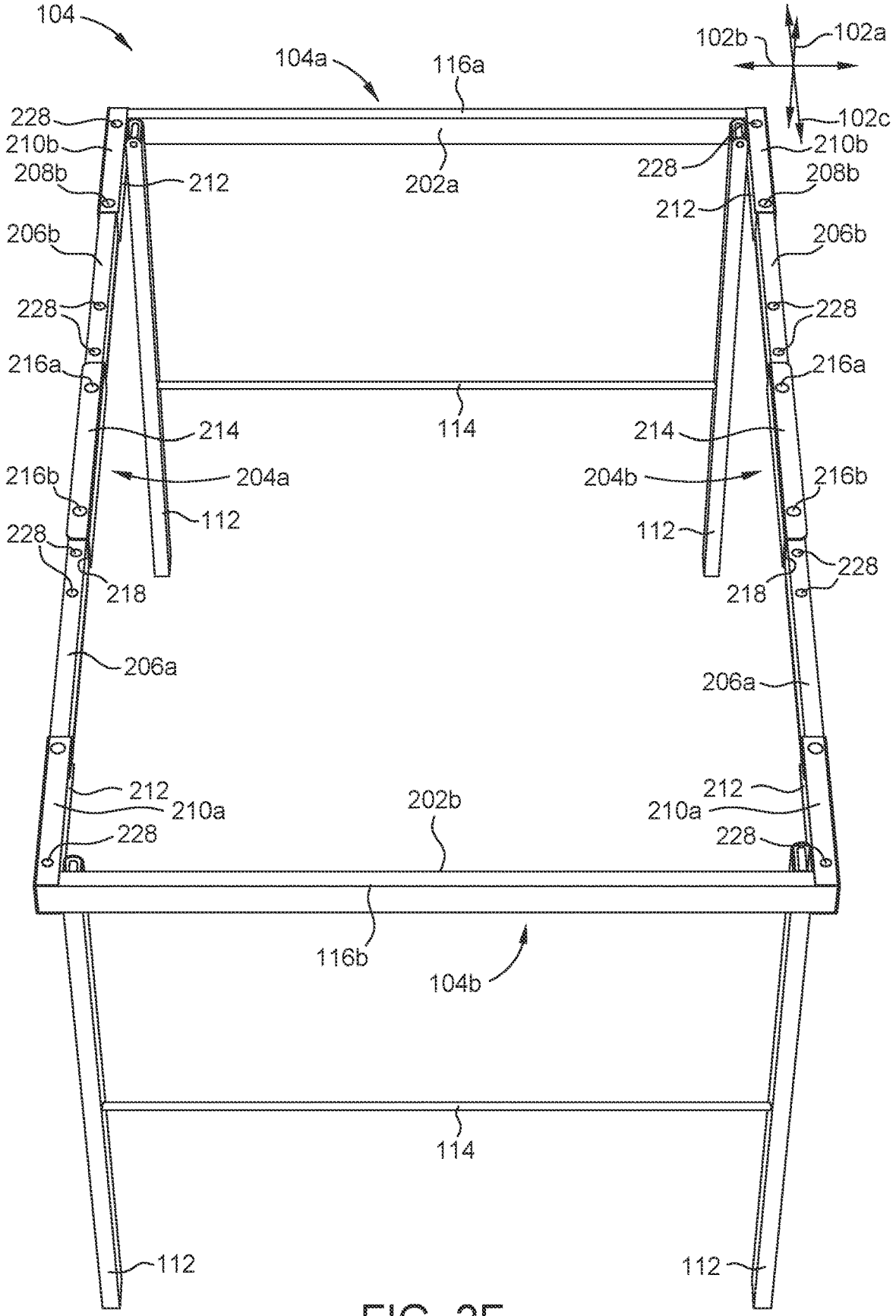
FIG. 2F illustrates the tabletop frame of the collapsible table in the deployed configuration in accordance with certain embodiments.

The user may urge the central segments 214 outwardly from one another until the deployed configuration of FIG. 2F is reached. As shown, in the deployed configuration, the central segments 214 form portions of the edges and outer perimeter of the tabletop frame 104. In some embodiments, the tabletop frame 104 may also be used in the intermediate configuration shown in FIG. 2E. For example, in the intermediate configuration, N−1 (e.g., two) panels 106 may be rested on the tabletop frame 104, whereas N (e.g., three) panels 106 will fit on the tabletop frame 104 in the deployed configuration (see, e.g., FIGS. 1B and 1C), where N is an integer greater than two. As shown in FIG. 2F, in the deployed configuration, the pivotable portions 206*a*. 206*b* are seated within the cavities 212 of the extensions 210*a*, 210*b* and within the cavity 218 of the central segment 214, which resists flexing of the collapsible sides 204*a*, 204*b* in planes parallel to the vertical direction 102*c*.

Figure 2G:
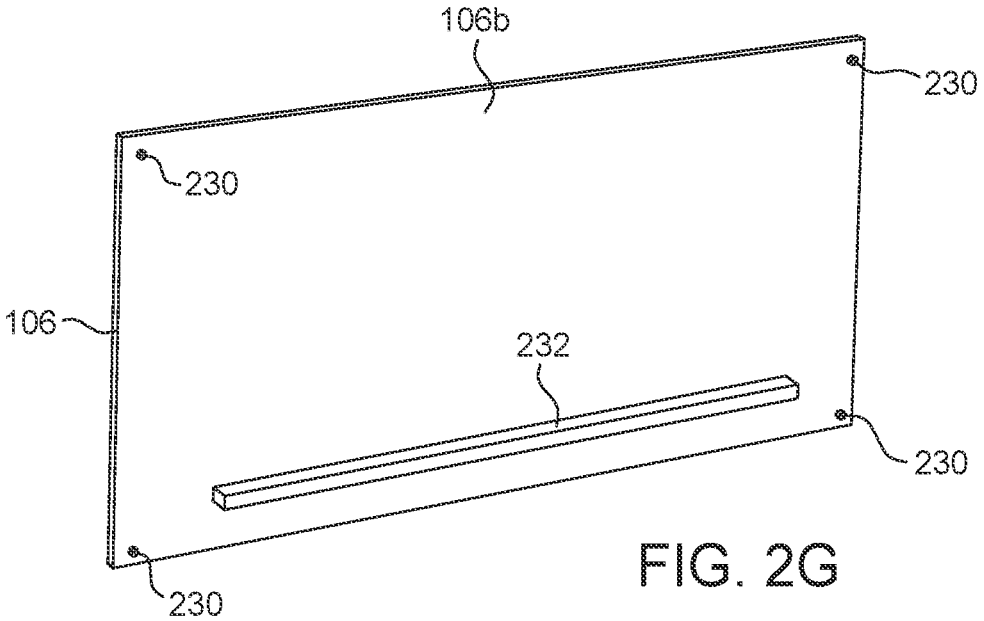
FIG. 2G illustrates a panel of the collapsible table, in accordance with certain embodiments.

Referring to FIG. 2G while still referring to FIG. 2F, the tabletop frame 104 may define a plurality of registration structures 228 that engage corresponding registration structures 230 formed on the panels 106. The engagement of the registration structures 228, 230 with one another both (a) resists inward movement of the central segments 214 toward one another and (b) resists sliding of the panels 106 relative to the tabletop frame 104. In the illustrated embodiment, the registration structures 228 are embodied as openings in the upper surface 104*a* of the tabletop frame 104 and the registration structures 230 are embodied as pins that are sized and positioned to insert within the openings when the tabletop frame 104 is in the deployed configuration. The pins may extend from a surface 106*b* of the panels 106 opposite the planar surface 106*a*. The reverse is also possible: pins secured to the tabletop frame 104 may engage openings defined by the panels 106. In some embodiments, a portion of the panels 106, such as two of the illustrated three panels 106, may have registration structures 230 configured to engage the registration structures 228 when the tabletop frame 104 is in the intermediate configuration.

As shown in FIG. 2G, some or all of the panels 106 may include one or more ribs 232 on the surface 106*b* opposite the planar surface 106*a*. The ribs 232 may be secured to the panels 106 or formed with the panels 106 by co-molding or some other process. The ribs 232 may serve to stiffen the panels 106 to prevent deflection during use. The ribs 232 may additionally facilitate aligning the panels 106 between the collapsible sides 204*a*, 204*b*. The ribs 232 may be oriented substantially (e.g., within 10 degrees of) parallel to the longitudinal direction 102*b* when the panels 106 are placed on the tabletop frame 104, though other configurations may also be used.

Figure 3A:
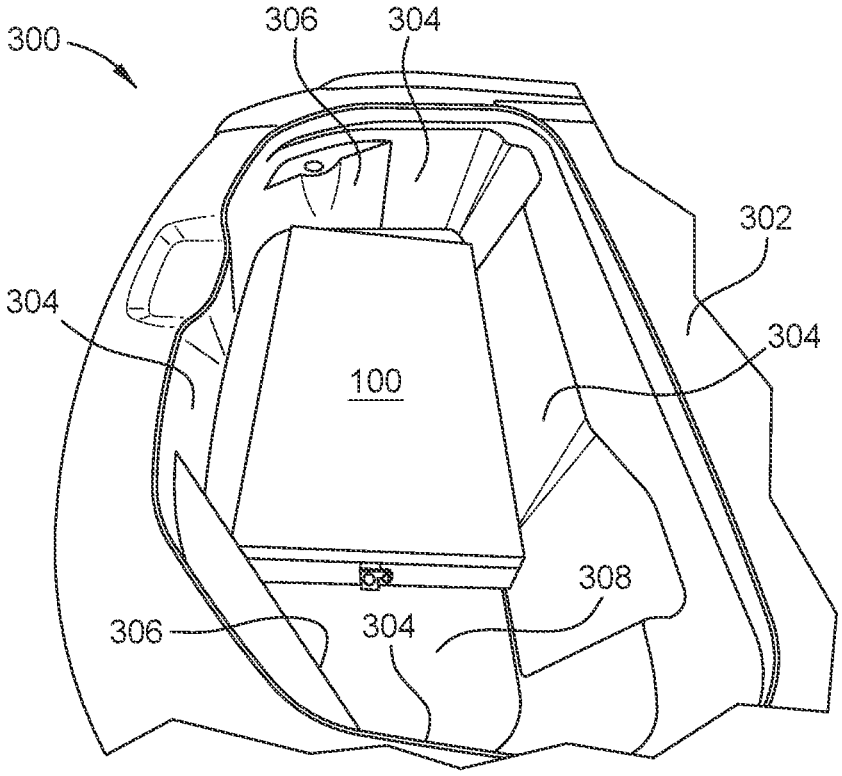
FIG. 3A illustrates the collapsible table positioned within a storage compartment of a vehicle while in the collapsed configuration, in accordance with certain embodiments.

Referring to FIG. 3A, the table 100 in the collapsed configuration may be sized to fit within a storage compartment 300 of a vehicle, such as the frunk or trunk of a vehicle 302. The storage compartment 300 may include one or more walls 304 that are oriented substantially vertically (e.g., parallel to gravity with the vehicle 302 resting on a flat surface) or slightly slanted (e.g., within 20 degrees relative to vertical). The walls 304 may conform to a rectangle in planes perpendicular to vertical. The storage compartment 300 may further include one or more walls 306 that are non-rectangular in planes perpendicular to vertical, such as the illustrated walls 306 that are oriented diagonally (e.g., between 25 and 65 degrees from parallel or perpendicular to the walls 306) or rounded corners between the walls 304. The dimensions 108*a*, 108*b* of the table 100 in the collapsed configuration may be selected to fit within the largest rectangular shape that may be defined on a floor 308 of the storage compartment 300 extending across an area between the walls 304, 306 of the storage compartment 300.

Figure 3B:
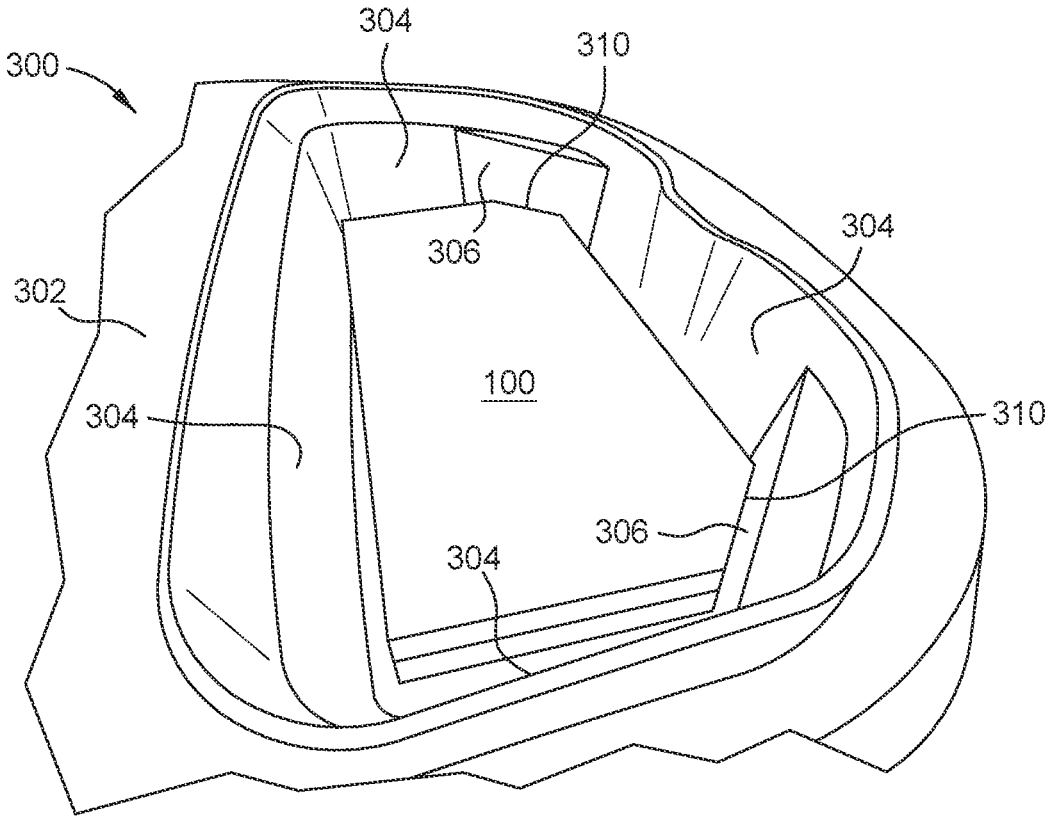
FIG. 3B illustrates a collapsible table shaped to conform to a non-rectangular shape of a storage compartment of a vehicle.
Figure 3C:
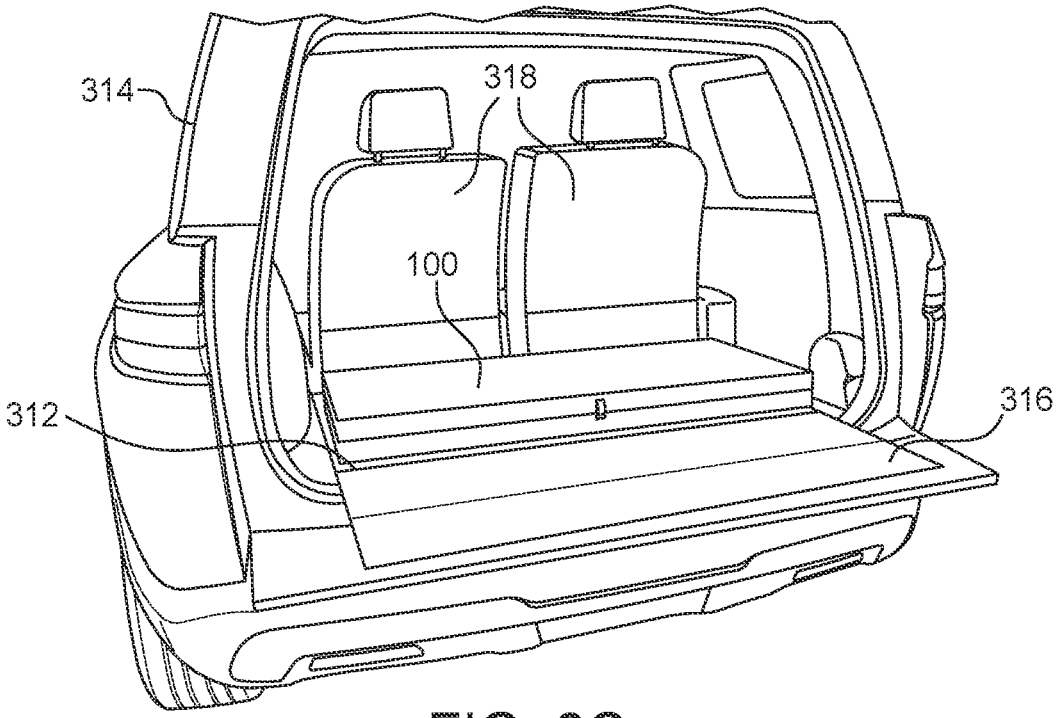
FIG. 3C illustrates the collapsible table placed in a cargo area of a vehicle, in accordance with certain embodiments.

Referring to FIG. 3B, in other embodiments, the tabletop frame 104 and one or more of the panels 106 may include beveled corners 310 sized and shaped to conform to the non-rectangular walls 306, thereby increasing the size of the table 100 that can fit within the storage compartment. Referring to FIG. 3C, in other embodiments and/or methods of use, the table 100 in the collapsed configuration is positioned within a cargo area 312 of a vehicle 314 located in front of a tailgate 316 and/or rear liftgate, or rear door of the vehicle 314 and behind the seats 318 of the vehicle 314. The vehicle 314 may be embodied as a sport utility vehicle, hatchback, or other type of vehicle.

In the methods of use shown in FIGS. 3A, 3B, and 3C, the table 100 is rested flat on the floor 308 or cargo area 312. However, other methods of use are possible, such as with the table 100 oriented vertically (dimensions 108*a* or 108*b* oriented substantially (e.g., within 15 degrees of) parallel to vertical.

Figure 4:
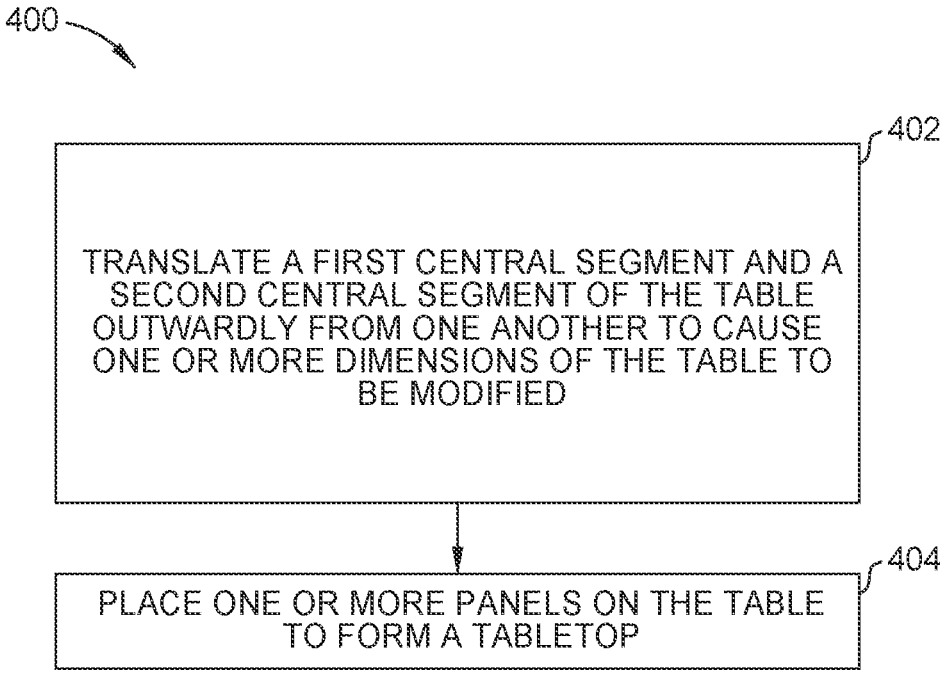
FIG. 4 is a process flow diagram of a method for deploying a collapsible table, in accordance with certain embodiments.

Referring to FIG. 4, a method 400 for deploying a table, such as the table 100, includes translating, at block 402, a first central segment and a second central segment of the table, such as the central segments 214 of the collapsible sides 204*a*, 204*b*, outwardly from one another to cause one or more dimensions of the table to be modified, such as by modifying the dimension 108*a* to the dimension 108*c*, as described above. The table may include a plurality of joints configured to facilitate the translation of the first central segment and the second central segment, such as the pilotable portions 206*a*, 206*b* and the central segments 214 of the collapsible sides 204*a*, 204*b*. The method 400 further includes placing, at block 404, one or more panels on the table to form a tabletop, such as the panels 106 described above.

In one or more embodiments, movement of the first central segment and the second central segment modifies the table from having a first length to having a second length, such as from having the dimension 108*a* to having the dimension 108*c*. The first central segment and the second central segment may support the tabletop of the table. The first length may be an integer multiple of the second length, and a number of the one or more panels may be equal to the integer multiple. The first length may correspond to a collapsed configuration, and the second length may correspond to a deployed configuration. The first central segment and the second central segment may be substantially parallel to one another in both the collapsed configuration and the deployed configuration. In some embodiments, the first central segment and the second central segment are positioned within an outer perimeter of the table in the collapsed configuration and positioned at the outer perimeter of the table in the deployed configuration. For example, as shown in FIG. 2A, in a collapsed configuration, the central segments 214 are positioned within the perimeter of the tabletop frame 104 and, as shown in FIG. 2F, in the deployed configuration, the central segments 214 are positioned at the perimeter of the tabletop frame 104.

In some embodiments, the method 400 optionally includes translating a first end segment and a second end segment, such as the first and second end segments 116*a*, 116*b*, outwardly from one another. A first collapsible side including the first central segment may be secured to the first end segment and the second end segment, and a second collapsible side including the second central segment may be secured to the first end segment and the second end segment, the first collapsible side and the second collapsible side including the plurality of joints. The method 400 may further include securing a plurality of legs to the first end segment and the second end segment, such as the legs 112 as described above. In some embodiments, one or both of (a) the first and second collapsible sides and (b) the first and second end segments define one or more first registration features, and the one or more panels define one or more second registration features, such as the registration features 228, 230, as described above.

Placing the one or more panels on the table may include engaging the one or more first registration features with the one or more second registration features such that the one or more panels resist inward movement of the first and second central segments. Securing the plurality of legs to the first end segment and the second end segment may include pivoting the plurality of legs outwardly from the first end segment and the second end segment.

The descriptions of the various embodiments of the present disclosure have been presented for purposes of illustration. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

In the preceding, reference is made to embodiments presented in this disclosure. However, the scope of the present disclosure may exceed the specific described embodiments. Instead, any combination of the features and elements, whether related to different embodiments, is contemplated to implement and practice contemplated embodiments. Furthermore, although embodiments disclosed herein may achieve advantages over other possible solutions or over the prior art, the embodiments may achieve some advantages or no particular advantage. Thus, the aspects, features, embodiments and advantages discussed herein are merely illustrative.

While the foregoing is directed to embodiments of the present disclosure, other and further embodiments may be devised without departing from the basic scope thereof, and the scope thereof is determined by the claims that follow.

What is claimed is:

1. An apparatus, comprising:

a table comprising:

a first central segment;

a first pivotable portion pivotally secured to an extension and pivotally secured to the first central segment;

a first control arm pivotally secured to the extension and pivotally secured to the first central segment;

a second central segment; and a plurality of joints configured to facilitate movement of the first central segment and the second central segment, wherein the movement of the first central segment and the second central segment causes one or more dimensions of the table to be modified.

2. The apparatus of claim 1, wherein the movement of the first central segment and the second central segment modifies the table from having a first length to having a second length, and wherein the first central segment and the second central segment are configured to support a tabletop.

3. The apparatus of claim 2, wherein:

the second length is an integer multiple of the first length, and at the second length, the table is configured to support the tabletop comprising a plurality of panels, a number of the plurality of panels being equal to the integer multiple.

4. The apparatus of claim 2, wherein the first length corresponds to a collapsed configuration of the table, the second length corresponds to a deployed configuration of the table, and the first central segment and the second central segment remain substantially parallel to one another while the table is transitioned between the collapsed configuration and the deployed configuration.

5. The apparatus of claim 4, wherein the first central segment and the second central segment are:

positioned within an outer perimeter of the table in the collapsed configuration, and positioned at the outer perimeter of the table in the deployed configuration.

6. The apparatus of claim 1, wherein the table further comprises:

a first collapsible side comprising the first central segment, the first collapsible side secured to a first end segment and a second end segment; and a second collapsible side comprising the second central segment, the second collapsible side secured to the first end segment and the second end segment, wherein the first collapsible side and the second collapsible side comprise the plurality of joints.

7. The apparatus of claim 6, wherein:

the first collapsible side further comprises:

the first pivotable portion pivotally secured to the first end segment via the extension; and a second pivotable portion pivotally secured to the second end segment, wherein the first central segment is pivotally secured to the first pivotable portion and pivotally secured to the second pivotable portion; and the second collapsible side further comprises:

a third pivotable portion pivotally secured to the first end segment; and a fourth pivotable portion pivotally secured to the second end segment, wherein the second central segment is pivotally secured to the third pivotable portion and pivotally secured to the fourth pivotable portion.

8. The apparatus of claim 7, wherein:

the first collapsible side further comprises:

the first control arm pivotally mounted to the first end segment via the extension; and a second control arm pivotally mounted to the second end segment and pivotally mounted to the first central segment; and the second collapsible side further comprises:

a third control arm pivotally mounted to the first end segment and pivotally mounted to the second central segment; and a fourth control arm pivotally mounted to the second end segment and pivotally mounted to the second central segment.

9. The apparatus of claim 8, wherein the first pivotable portion and the second pivotable portion are pivotally mounted to the first central segment between the first control arm and second control arm, and the third pivotable portion and the fourth pivotable portion are pivotally mounted to the second central segment between the third control arm and fourth control arm.

10. The apparatus of claim 6, wherein one or both of (a) the first and second collapsible sides and (b) the first and second end segments define a plurality of first registration features, the apparatus further comprising:

one or more panels configured to rest on at least one of the first and second collapsible sides and the first and second end segments to form a tabletop, the one or more panels defining a plurality of second registration features configured to engage the plurality of first registration features.

11. The apparatus of claim 6, wherein the table comprises a plurality of legs secured to the first end segment and the second end segment, the plurality of legs being pivotable into (a) a collapsed configuration substantially parallel to the first end segment and the second end segment and (b) a deployed configuration substantially perpendicular to the first end segment and the second end segment.

12. The apparatus of claim 2, wherein the tabletop defines one or more features configured to mount an accessory comprising one or more of:

a basin;

a stove; and a storage structure.

13. A method for deploying a table, comprising:

translating a first central segment and a second central segment of the table outwardly from one another to cause one or more dimensions of the table to be modified, wherein the table comprises a plurality of joints configured to facilitate the translation of the first central segment and the second central segment, wherein a first pivotable portion is pivotally secured to an extension and pivotally secured to the first central segment, and a first control arm is pivotally secured to the extension and pivotally secured to the first central segment; and placing one or more panels on the table to form a tabletop.

14. The method of claim 13, wherein movement of the first central segment and the second central segment modifies the table from having a first length to having a second length, and wherein the first central segment and the second central segment are configured to support the tabletop of the table.

15. The method of claim 14, wherein the first length is an integer multiple of the second length, and a number of the one or more panels is equal to the integer multiple.

16. The method of claim 14, wherein the first length corresponds to a collapsed configuration, the second length corresponds to a deployed configuration, and the first central segment and the second central segment remain substantially parallel to one another while the table is transitioned between the collapsed configuration and the deployed configuration.

17. The method of claim 16, wherein the first central segment and the second central segment are:

positioned within an outer perimeter of the table in the collapsed configuration, and positioned at the outer perimeter of the table in the deployed configuration.

18. The method of claim 13, further comprising:

translating a first end segment and a second end segment outwardly from one another, wherein a first collapsible side comprising the first central segment is secured to the first end segment and the second end segment, and a second collapsible side comprising the second central segment is secured to the first end segment and the second end segment, the first collapsible side and the second collapsible side comprising the plurality of joints; and securing a plurality of legs to the first end segment and the second end segment.

19. The method of claim 18, wherein one or both of (a) the first and second collapsible sides and (b) the first and second end segments define one or more first registration features, and the one or more panels define one or more second registration features, and wherein placing the one or more panels on the table comprises engaging the one or more first registration features with the one or more second registration features such that the one or more panels resist inward movement of the first and second central segments.

20. The method of claim 18, wherein securing the plurality of legs to the first end segment and the second end segment comprises pivoting the plurality of legs outwardly from the first end segment and the second end segment.

* * * * *